US010463946B2

(12) United States Patent
Shute et al.

(10) Patent No.: US 10,463,946 B2
(45) Date of Patent: Nov. 5, 2019

(54) TOURING BINDING HEEL UNIT

(71) Applicant: G3 GENUINE GUIDE GEAR INC., Burnaby, BC (CA)

(72) Inventors: Cameron Shute, Nelson (CA); Mark Richard Mosher, Whistler (CA)

(73) Assignee: G3 GENUINE GUIDE GEAR INC., Burnaby, BC (CA)

( * ) Notice: Subject to any disclaimer, the term of this patent is extended or adjusted under 35 U.S.C. 154(b) by 0 days.

(21) Appl. No.: 15/615,947

(22) Filed: Jun. 7, 2017

(65) Prior Publication Data

US 2018/0353839 A1 Dec. 13, 2018

(51) Int. Cl.

| | |
|---|---|
| ***A63C 9/00*** | (2012.01) |
| ***A63C 9/084*** | (2012.01) |
| ***A63C 7/10*** | (2006.01) |
| ***A63C 9/08*** | (2012.01) |
| ***A63C 9/086*** | (2012.01) |

(52) U.S. Cl.

CPC ..... *A63C 9/0845* (2013.01); *A63C 7/1026* (2013.01); *A63C 7/1053* (2013.01); *A63C 9/005* (2013.01); *A63C 9/006* (2013.01); *A63C 9/0805* (2013.01); *A63C 9/086* (2013.01); *A63C 9/0807* (2013.01); *A63C 9/0846* (2013.01)

(58) Field of Classification Search

CPC ..... A63C 9/0845; A63C 9/006; A63C 9/0844; A63C 9/0807; A63C 9/0846; A63C 9/00; A63C 9/0843; A63C 9/08528; A63C 7/102; A63C 7/1026; A43B 5/0417; A43B 5/0496

USPC ..... 280/614, 627, 607

See application file for complete search history.

(56) References Cited

U.S. PATENT DOCUMENTS

| | | | |
|---|---|---|---|
| 8,439,389 | B2 | 5/2013 | Moore et al. |
| 8,746,728 | B2 | 6/2014 | Shute et al. |
| 9,149,710 | B2 | 10/2015 | Moore et al. |
| 9,242,167 | B2 | 1/2016 | Shute et al. |

(Continued)

FOREIGN PATENT DOCUMENTS

| | | | |
|---|---|---|---|
| AT | 402020 | B | 1/1997 |
| EP | 0199098 | B | 10/1986 |
| EP | 0519243 | B | 12/1992 |

(Continued)

*Primary Examiner* — Paul N Dickson
*Assistant Examiner* — Hilary L Johns

(57) ABSTRACT

An apparatus for holding a footwear heel to a snow travel aid is provided. The apparatus comprises a mountable base connected to a generally vertical post and an upper portion having at least one forward connector for connecting the upper portion to the heel. The upper portion is rotatable on the post between a downhill position and at least one touring position and comprises at least one part which travels over a prominence at a fixed location relative to the upper portion during rotation from the downhill position to the touring position. The at least one part becomes engageable with a depression adjacent the prominence when the upper portion is in the touring position to resist rotation from the touring position back to the downhill position. The post comprises a feature that provides clearance for the at least one part to travel over the prominence or which functions as the prominence and depression. Also provided are posts for use as a part in such an apparatus.

31 Claims, 19 Drawing Sheets

(56) References Cited

U.S. PATENT DOCUMENTS

| | | | | |
|---|---|---|---|---|
| 9,597,578 | B2 | 3/2017 | Moore et al. | |
| 2015/0014963 | A1* | 1/2015 | Shute | A63C 7/102<br>280/614 |

FOREIGN PATENT DOCUMENTS

| | | | |
|---|---|---|---|
| EP | 1559457 | B | 8/2005 |
| EP | 2384794 | B | 11/2011 |
| EP | 2638937 | B | 9/2013 |
| WO | 0044846 | A1 | 8/2000 |

* cited by examiner

TOURING BINDING HEEL UNIT

FIELD

This invention relates to release bindings used in alpine ski touring, also known as "Randonnee".

BACKGROUND

Alpine touring bindings allow the heel of the user's footwear (such as a ski boot) to be latched to a ski or other snow travel aid for sliding downhill (the "downhill mode") and allow the heel to be released for walking and climbing (the "touring mode"). Thus, the binding allows for selective holding of the footwear heel to the snow travel aid so that the user may select between the downhill mode and the touring mode. Modern alpine touring bindings allow the footwear to release from the snow travel aid when in the downhill mode, in case of a fall. When in the touring mode, the user may climb or walk with a great degree of freedom since the footwear is pivotally engaged with the aid near the toe of the footwear while the heel of the footwear is free to move upward and downward relative to the aid. A historical collection of such bindings can be viewed in the "Virtual Museum of Backcountry Skiing Bindings" at www.wild-snow.com, authored by Louis Dawson.

Alpine touring bindings of the type that originated under the brand DYNAFIT are bindings that take advantage of the fact that modern alpine touring boots have a rigid sole. Thus, it is unnecessary to provide a bar, plate or other arrangement connecting toe and heel units, as is the case with many other alpine touring bindings (see patent publications EP0199098, EP0519243, EP1559457, and AT402020). This type of binding is referred to herein as a "Tech-type" binding.

Tech-type binding systems typically comprise a toe unit having a set of jaws that pivotally engage inserts in the footwear sole at the toe of the footwear. The toe unit is mountable at an appropriate location on the upper surface of a snow travel aid. A heel unit is mountable at a particular region on the upper surface rearward of the toe unit, the location of which is dictated by the length of the footwear sole. The toe and heel units function independently in retaining the footwear attached to the snow travel aid. The heel unit comprises one or more connectors (typically a pair of pins) which extend forward to engage a fitting placed in the rear of the footwear heel. Under forward release conditions during a fall, the pins are forced apart against spring pressure to respective release positions to disengage from the fitting and the heel. The pins typically communicate with a spring or springs through inclined sliding surfaces that move a block which engages the spring or springs.

The heel unit of a Tech-type type binding can facilitate lateral release in the case of a fall and allows transition to the touring mode as a result of the body of the heel unit being pivotally engaged on a generally vertical post. Variable release settings are provided by adjusting compression of a spring which forces a plunger against flat regions arranged around the circumference of the post on which the body rotates. The body of the heel unit will tend to stay in each rotational position corresponding to a flat region on the post, which facilitates retention of the heel unit in either the downhill or touring mode.

To switch between touring and downhill modes with such a system, it is necessary to rotate the heel unit so that the connector either engages the footwear heel (downhill position) or faces away from the heel (touring position). When the connector faces away, the footwear heel is free to move upward and downward to facilitate walking and climbing with the toe of the footwear pivotally retained on the snow travel aid by means of the toe unit. In order to switch from downhill mode to touring mode it is necessary to release the connector from the footwear heel first, whereupon the heel unit can be rotated to a touring position. This type of heel unit will occasionally rotate on its own from a touring position back to the downhill position as a result of snow build-up or jarring the binding. This can result in the heel unit becoming coupled to the footwear heel which interferes with touring. The device disclosed in EP0519243 compensates for this tendency by providing a one-way rotary coupling of the heel unit with a wedge member acting as a prominence that resists rotation in the opposite direction back to the downhill position.

Another Tech-type binding with a rotating heel unit is disclosed in U.S. 2015/0014963. That heel unit comprises an upper portion that is rotatable on a generally vertical axis between a downhill position and at least one lateral release position. The upper portion can rotate towards the lateral release position from the downhill position during a fall and is deliberately rotated to that position when the user places the binding in the touring mode. The upper portion comprises at least one camming surface such that rotation of the upper portion results in the at least one camming surface contacting a stop causing the upper portion to translate rearwardly away from the stop, against a force exerted by a forward biasing device. As disclosed in U.S. 2015/0014963, the upper portion can be releasably retained in the touring position against the force exerted by the forward biasing device by engagement of a detent in the camming surface with a fixed feature and/or by a part of the upper portion being engaged with a depression that is fixed relative to the upper portion. Such a depression may be behind a prominence over which a lobe on the upper portion rides when rotating to the touring position. Once the lobe is over the depression, weighting the apparatus by the user restricts the lobe from returning back over the ramp.

SUMMARY

This disclosure provides an apparatus for holding a footwear heel to a snow travel aid, the apparatus comprising a base mountable to the snow travel aid that is connected to a generally vertical post and an upper portion having at least one forward connector for connecting the upper portion to the heel, the upper portion being rotatable on the post between a downhill position and at least one touring position, the upper portion comprising at least one part which travels over a prominence at a fixed location relative to the upper portion during rotation from the downhill position to the touring position, wherein the at least one part becomes engageable with a depression adjacent the prominence when the upper portion is in the touring position; and wherein the post comprises a feature configured to: (i) provide clearance for the at least one part to travel over the prominence, or (ii) to function as the prominence and the depression. Engagement of the at least one part into the depression provides resistance against rotation back to the downhill position from the touring position. The prominence may extend upwardly to a high point adjacent the depression. The post may comprise at least one bearing surface and the feature may be a groove in the bearing surface. The apparatus may comprise a plunger of an Mz biasing device engaged with the bearing surface. The post may comprise a spindle between a cap and a pedestal and the groove and the at least one bearing surface may be on the cap, facing the pedestal.

The post may comprise a spindle between a cap and a pedestal and the groove and the at least one bearing surface may be on the spindle. The prominence may be a projection connected to said mountable base. The feature may be located on the post at a location over the prominence. The at least one part may be on a lobe connected to the upper portion that extends away from the axis of rotation of the upper portion. The post may be slidable relative to the mountable base. The at least one part may be on a lobe connected to the upper portion and the lobe may further comprise a camming surface that contacts a stop at a second fixed location relative to the upper portion. Rotation of the upper portion to the touring position may result in the upper portion translating rearwardly against an opposing force provided by a biasing device. The prominence may be located on a chassis that is positionable on the mountable base by an adjustor. The apparatus may further comprise a snow brake. The at least one part may become engaged with the depression during rotation to the touring position without weighting by the user. The apparatus may be configured such that weighting by a user when the apparatus is at the touring position causes or increases engagement of the at least one part with the depression. The apparatus may comprise two groups, each group being located at opposite sides of the apparatus with each group consisting of the at least one part, the prominence and the depression, and the upper portion may be rotatable in opposite directions. The at least one connector may be a pair of pins.

This disclosure also provides a post for use as a part in an apparatus for holding a footwear heel to a snow travel aid, the apparatus comprising a base mountable to the snow travel aid that is connected to the post and an upper portion engaged with the post and having at least one connector for connecting the upper portion to the heel, the upper portion being rotatable on the post between a downhill position and at least one touring position; wherein the post comprises a spindle between a cap and a pedestal, the cap and pedestal being larger in cross section than the spindle, the pedestal being joined to a post base having a larger cross section than the pedestal, the post base comprising a feature or features oriented in a generally longitudinal direction for slidable engagement of the post with said mountable base, the spindle comprising a primary flat zone generally facing in longitudinal direction and at least one secondary flat zone facing generally sideward, wherein an underside of the cap comprises a bearing surface and an upper surface of the pedestal comprises an opposing bearing surface and wherein the one or both of said bearing surfaces comprise at least one groove that increases clearance between said bearing surfaces at the location of the groove. The at least one groove may be located on the bearing surface on the underside of the cap. The at least one groove may increase clearance in an area that includes at least part of the at least one secondary flat zone. The post may comprise secondary flat zones on opposite sides of the spindle. The bearing surface on the underside of the cap may comprise grooves located over at least part of each of the secondary flat zones. A portion or portions of the surface of the spindle located between the flat zones may be curved, chamfered, or a combination there. Also provided is a method of assembling such an apparatus comprising engaging such a post with the mountable base and engaging the post with the upper portion. Also provided is a kit comprising such a post and instructions for its incorporation into such an apparatus.

This disclosure also provides a post for use as a part in an apparatus for holding a footwear heel to a snow travel aid, the apparatus comprising a base mountable to the snow travel aid that is connected to the post and an upper portion engaged with the post and having at least one connector for connecting the upper portion to the heel, the upper portion being rotatable on the post between a downhill position and at least one touring position; wherein the post comprises a spindle joined to a post base having a larger cross section than the spindle, the post base comprising a feature or features oriented in a generally longitudinal direction for slidable engagement of the post with said mountable base, the spindle providing a bearing surface that comprises a primary flat zone generally facing the longitudinal direction and at least one secondary flat zone facing generally sideward, and wherein the bearing surface of the spindle comprises at least one groove extending across at least part of the at least one secondary flat zone, the groove being shaped to provide a path containing a prominence followed by a depression in a direction extending away from the primary flat zone. The groove may extend across the secondary flat zone. The post may comprise secondary flat zones on opposite sides of the spindle, each comprising such a groove. A portion or portions of the bearing surface of the spindle located between the flat zones may be curved, chamfered, or a combination thereof. Also provided is a method of assembling such an apparatus comprising engaging such a post with the mountable base and engaging the post with the upper portion. Also provided is a kit comprising such a post and instructions for its incorporation into such an apparatus.

Further embodiments include such an apparatus mounted to a snow travel aid. In some embodiments, the snow travel aid is a ski and the footwear is a ski boot.

Further embodiments include a binding kit comprising toe and heel units. The heel unit is a heel unit as described above. The toe unit will be configured to function independently from the heel unit to retain the footwear toe on the snow travel aid while permitting forward and rearward movement of the footwear. The kit may further comprise instructions for one or more of installation, maintenance, adjustment and use of the toe and heel units. The kit may further comprise fasteners such as appropriate threaded fasteners for attachment of the toe and heel units to a snow travel aid. In some embodiments, the toe and heel units will not be connected except through mounting on a snow travel aid.

DETAILED DESCRIPTION OF PARTICULAR EMBODIMENTS

Snow travel aids as contemplated herein are devices that support a user and are adapted to slide on a snow surface. Examples include skis, other snow sliding devices shaped like a ski and snowboards. This includes devices known as "split-boards" (which are snowboards that can be separated longitudinally into at least two portions, the two portions then functioning in a manner similar to a pair of skis). Examples of such other devices include "ski blades", "snow blades", "ski boards", and "sliding" or "gliding snow shoes". An example of the latter device is the configurable snow shoe/ski device described in WO 2000/044846.

In this specification, reference to "Mz" refers to the lateral release characteristic that involves torque applied about an axis that is generally perpendicular to the upper surface of a snow travel aid. The term "My" refers to the forward release characteristic whereby torque is applied about an axis that is generally parallel to the upper surface and generally perpendicular to the longitudinal axis of the snow travel aid.

In this specification, reference to "generally vertical" is intended to indicate a general direction upwards or downwards from a reference line or place but does not require absolute perpendicularity to such reference. Conversely, the term "generally horizontal" is not limited to a direction that is absolutely perpendicular to a vertical reference. The term "generally parallel" would include lines or planes that are parallel to a reference line or plane as well as those which form an angle of less than 45 degrees with the reference. The term "generally perpendicular" is not limited to a 90 degree orientation but includes orientations that form an angle to a reference of greater than 45 degrees and less than 135 degrees.

In this specification, the term "longitudinal" relates to the longitudinal axis and hence, the direction of travel of a snow travel aid. The term "generally longitudinal" includes an orientation that is or is intended to be parallel to the longitudinal axis or direction of travel of a snow travel aid and also includes orientations at an angle of less than 45 degrees to the longitudinal axis or direction of travel of the snow travel aid. The terms "forward" and "rearward" relate to forward and rearward directions of travel of a snow travel aid. The terms "generally forward" and "generally rearward" include orientations or directions which form an angle of less than 45 degrees to the longitudinal axis of the snow travel aid. The term "sideward" relates to a direction that is generally perpendicular to the longitudinal axis or direction of travel of a snow travel aid. Thus, the term "generally sideward" includes directions that form an angle to the longitudinal axis or direction of travel of the snow travel aid that is greater than 45 degrees.

Figure 1A:
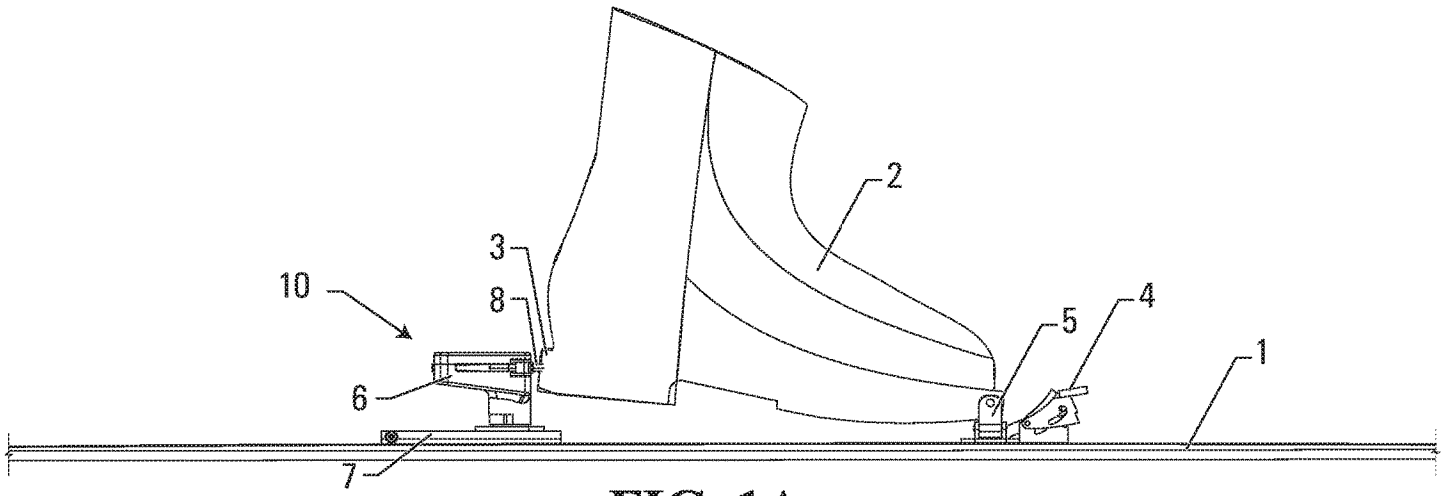
FIG. 1A Prior Art
FIGS. 1A and 1B are side and plan views, respectively of a ski, ski boot and a prior art binding system.
Figure 1B:
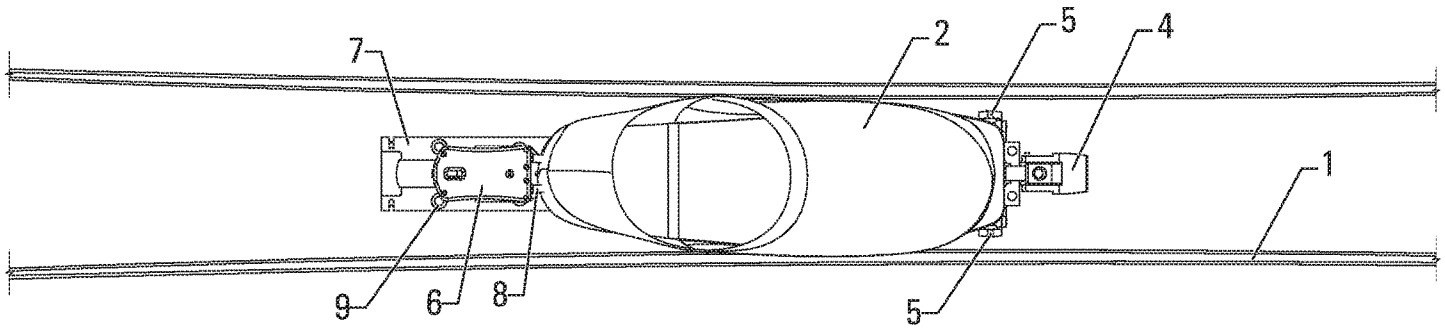
FIG. 1B Prior Art

FIGS. 1A and 1B show a prior art DYNAFIT™ binding system, including toe unit 4 and heel unit 10 mounted on the upper surface of ski 1. The toe unit comprises jaws 5 that pivotally engage with special fittings (not shown) embedded in the toe of ski boot 2. Dual pins 8 on heel unit 10 engage the rear portion of the boot heel 3. The heel unit comprises a base plate 7 fixed to the ski surface by multiple fasteners 9. Upper portion 6 of the heel unit contains forward directed projections, which are illustrated as a pair of pins 8. The arrangement shown in FIGS. 1A and 1B is the downhill mode with both the toe and heel of the boot engaged by the binding system. It should be noted that pins 8 are visible in the downhill mode in a gap between boot heel 3 and a forward side of upper portion 6.

Figure 2A:
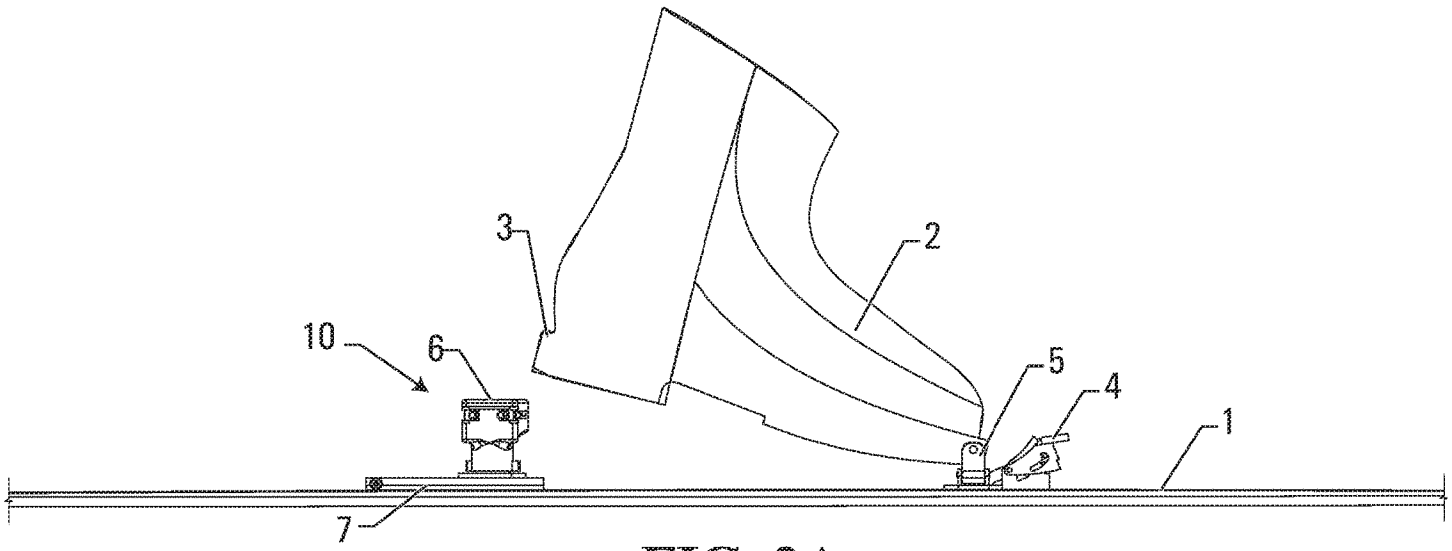
FIG. 2A Prior Art
FIGS. 2A and 2B are side and plan views, respectively showing the combination illustrated in FIGS. 1A and 1B in a touring mode.
Figure 2B:
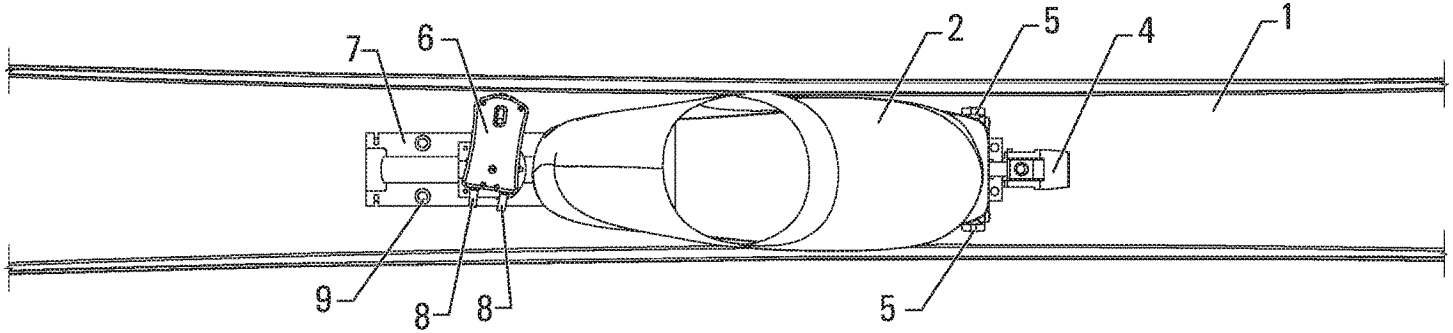
FIG. 2B Prior Art

FIGS. 2A and 2B show the prior art DYNAFIT™ system positioned in the touring mode. The toe of the boot remains pivotally engaged to toe unit 4. The heel is free to move up and down relative to the ski because upper portion 6 of the heel unit has been rotated so that pins 8 face away from boot heel 3. In some DYNAFIT™ models, upper portion 6 may be further rotated (not shown) such that pins 8 face rearward of the ski thereby allowing the boot heel 3 to come to rest on an upper surface of upper portion 6. This reduces stress on the user's muscles and tendons while climbing steep hills. In some embodiments, the upper portion 6 may further comprise a heel lift extension (not shown) or foldable heel lifts to permit the user to further elevate the boot heel while climbing steep hills.

In order to switch from the downhill mode shown in FIGS. 1A and 1B to the touring mode shown in FIGS. 2A and 2B, one must free the pins 8 from the boot heel. One method for doing so is to disengage the boot toe from jaws 5, thereby completing exiting the binding system at which point the user is no longer resting on the ski.

Figure 3:
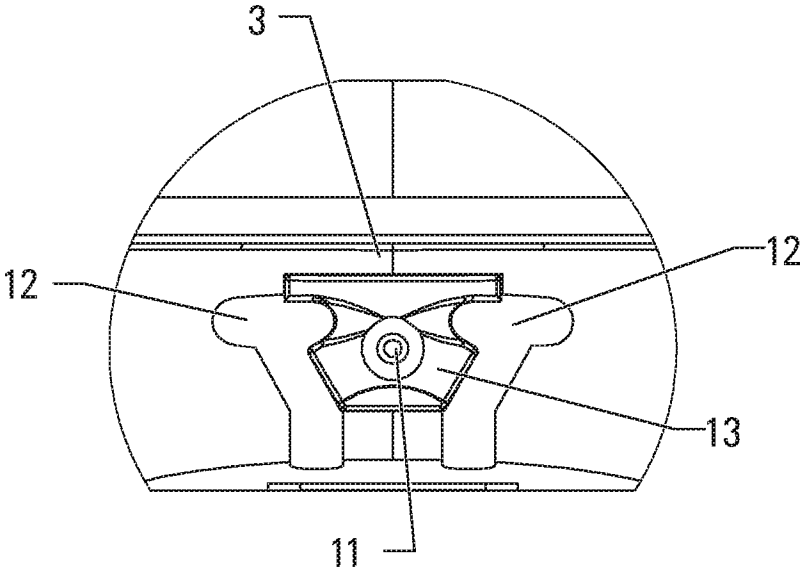
FIG. 3 Prior Art
FIG. 3 is a partial end view of a boot heel containing a prior art fitting for receiving pins of a prior art heel unit.

FIG. 3 shows part of the rear end of a boot and the prior art boot heel fitting adapted to engage the pins of the prior art DYNAFIT™ heel unit. The upper boot is not shown. Metallic insert 13 is fixed to heel 3 by means of fastener 11. Arcuate cut-away portions on opposite sides of the insert accommodate the pins of the heel unit. These arcuate portions are placed over cavities 12 in the boot heel which receive the ends of the pins.

As will be discussed below, the present invention relates to improvements in an apparatus for holding a footwear heel to a snow travel aid. The apparatus is mountable to the snow travel aid and comprises at least one forward connector for connecting an upper portion of the apparatus to the heel. The upper portion is rotatable on a generally vertical axis between a downhill position and at least one touring position.

An apparatus employing the present invention may comprise components of a prior art heel unit as disclosed in U.S. 2015/0014963 and shown in FIGS. 4-14 herein. That particular apparatus comprises at least one camming surface positioned such that rotation of the upper portion toward the touring position results in the upper portion translating rearwardly against an opposing force provided by a forward biasing device. The camming surface may be on a lobe connected to the upper portion and may have an axis of rotation that is the same as the axis of rotation of the upper portion. However, the present invention may also be employed in other bindings of the Tech-type in which the heel unit rotates on a generally vertical post.

Figure 4B:
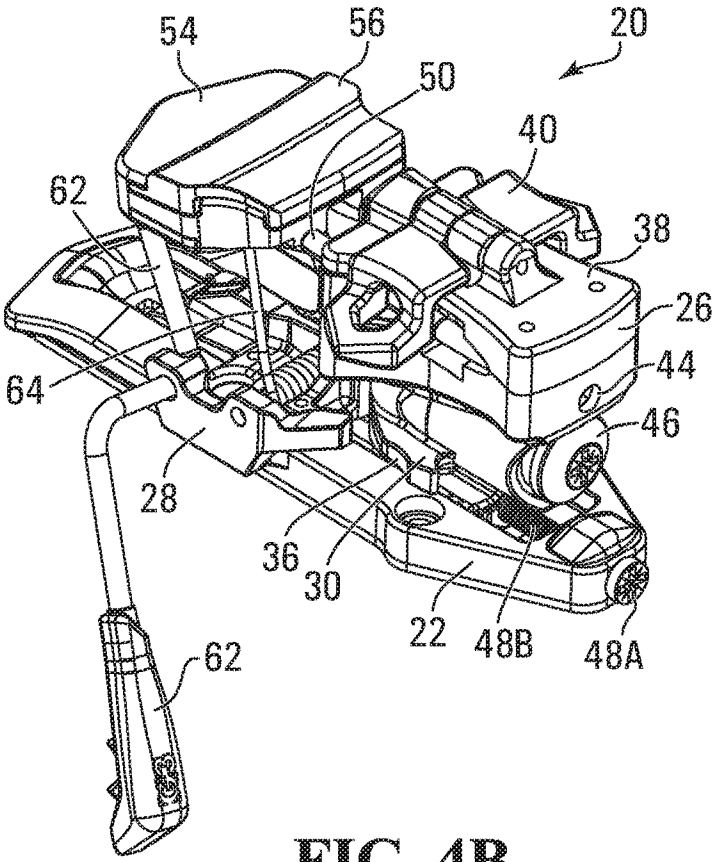
FIG. 4B Prior Art
FIGS. 4A and 4B are perspective views of a prior art heel unit with snow brake positioned for downhill skiing (downhill mode).
Figure 4A:
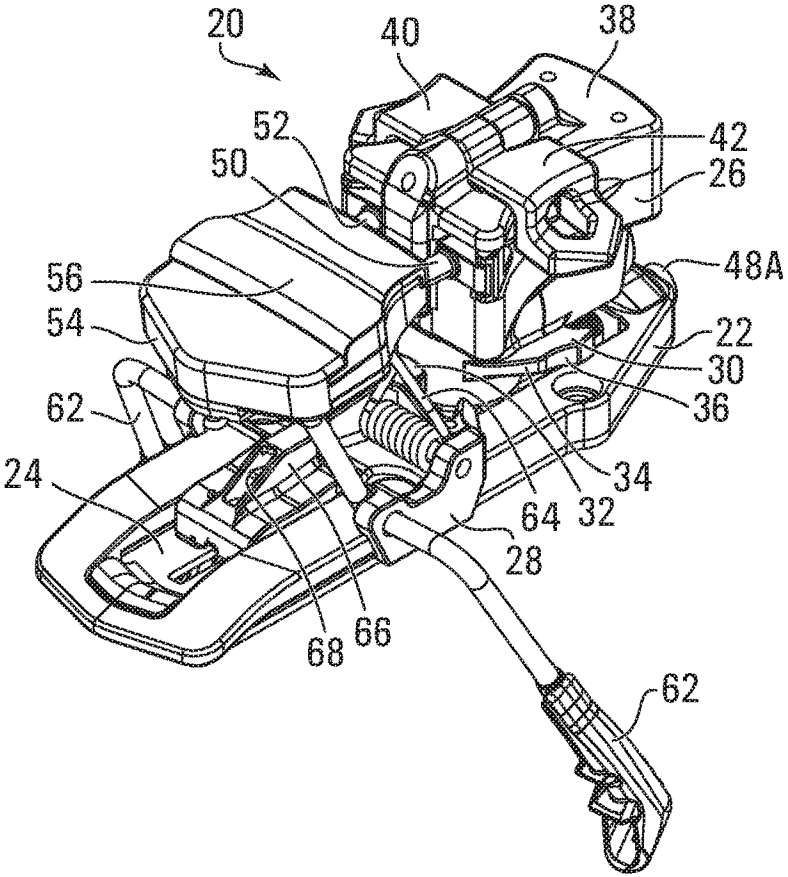
FIG. 4A Prior Art

FIGS. 4A and 4B are perspective views illustrating a heel unit as disclosed in U.S. 2015/0014963 in downhill mode. Heel unit 20 is intended to be mounted to the upper surface of the snow travel aid, by means of fasteners (such as screws) that would extend through apertures in base plate 22. The base plate contains a channel 24 in which upper portion 26 and ski brake chassis 28 are slidably engaged. Upper portion 26 is similar in function to the corresponding part of a DYNAFIT™ heel unit except that at least one lobe 30 is situated on the exterior of the upper portion body which forms a camming surface that will engage a part such as boss 32 on the brake chassis that is fixed relatively to the upper portion when the upper portion is rotated to place the heel unit in the touring position. In the embodiment illustrated, matching lobes 30 are placed on opposite sides of the upper portion and will alternately engage boss 32 depending upon the direction in which the upper portion is rotated. In this embodiment, lobe 30 comprises camming surface 34 and detent 36. Engagement of detent 36 with boss 32 will assist in retaining the upper portion in a touring position. Cover 38 on upper portion 26 is removable for access to an interior portion of upper portion 26 containing the My release components. Stowable heel lifts 40 and 42 are attached to the cover and provide different elevated platforms on which to rest the boot heel when the binding is in the touring mode. Adjustment of pre-load on the My release components is by means of an adjustor accessed through aperture 44. Mz adjustor/spring cap 46 is turned to adjust pre-load on the Mz release components which are contained within upper portion 26 beneath the My release components. Positioning of the upper portion 26 and brake chassis 28 within channel 24 of base plate 22 is accomplished by rotating the head 48A of an adjustor having a threaded portion 48B. The My release components comprise a pair of pins 50 & 52 which extend forward and are for engagement in an appropriate fitting in the boot heel. Brake pad 54 contains sliding cover 56 which acts as an anti-friction device. A pair of brake arms 62 extend through apertures in chassis 28 and are rotatably engaged with brake pad 54. Spring 64 biases the brake pad upwards and the brake arms downwards when the binding is in the downhill position and no boot is engaged in the binding. Located on chassis 28 is housing 66 containing hook 68 which is for engagement with a portion of spring 64 to retain the brake in a touring position with pad 54 depressed and arms 62 raised above the snow surface.

Figure 5B:
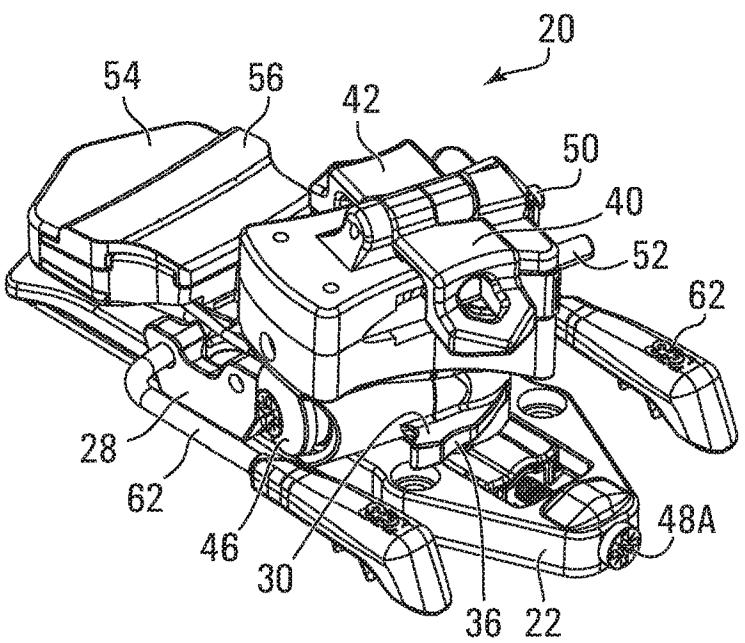
FIG. 5B Prior Art
FIGS. 5A and 5B are perspective views of the prior art heel unit shown in the preceding drawing positioned for touring (touring mode).
Figure 5A:
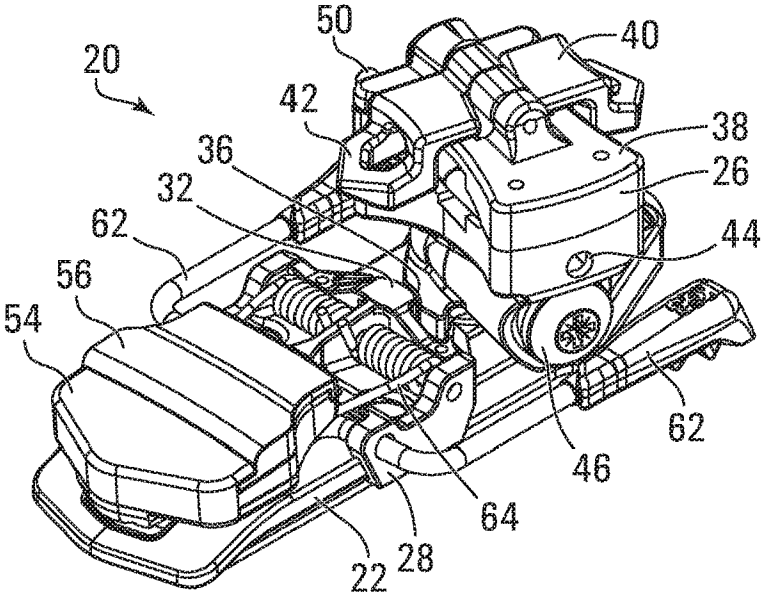
FIG. 5A Prior Art

FIGS. 5A and 5B illustrate perspective views of the prior art heel unit shown in FIGS. 4A and 4B when in a touring position. Upper portion 26 has been rotated so that pins 50 and 52 are directed toward the side of the heel unit and cannot engage the boot heel. The ski brake is in the touring position with brake pad 54 held in the depressed position so that the boot is free to move up and down without the brake being engaged. Brake arms 62 are in the raised position so they will not contact the snow surface. As shown in FIG. 5B, one of lobes 30 is not engaged whereas the lobe on the opposite side of upper portion 26 is engaged at detent 36 on boss 32. When rotating to the position shown in FIG. 5A, cam surface 34 travels along boss 32 causing upper portion 26 to be translated away from chassis 28 to provide clearance for the boot heel during touring. In this embodiment, translation of upper portion 26 away from chassis 28 also causes hook 68 to engage the brake and retain it in the touring position. Heel lift 42 shown in FIG. 5A may be pivoted away from the boot to allow the boot heel to pass in front of upper portion 26 and rest on snow plate 70. Snow plate 70 is shaped to help break up snow and/or ice that may build up beneath the boot heel.

Figure 6:
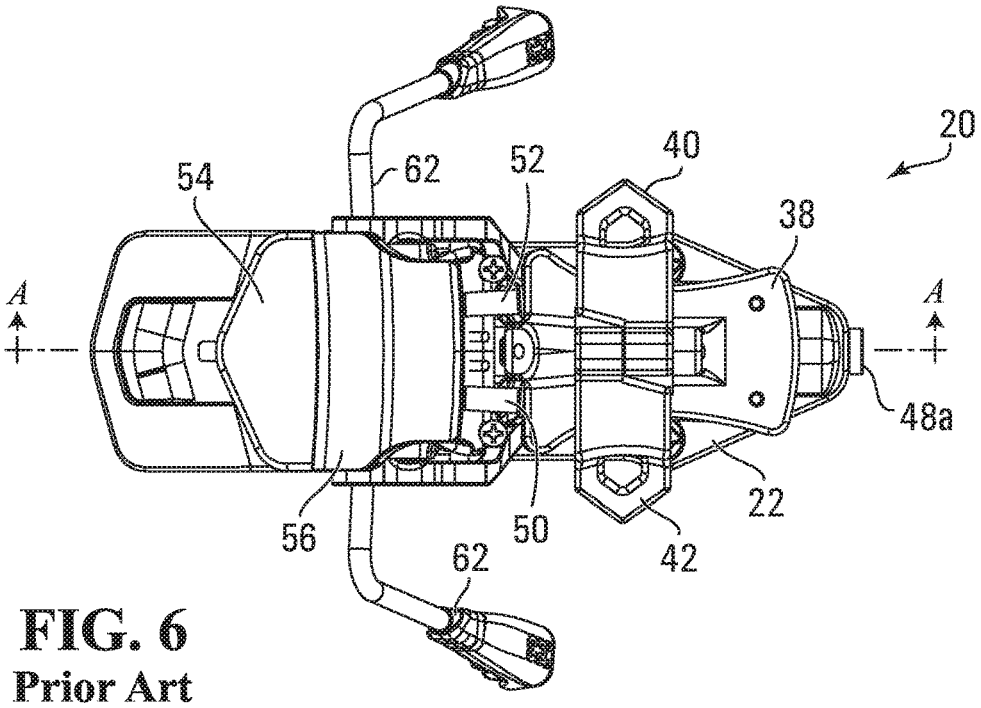
FIG. 6 Prior Art
FIG. 6 is a top view of the prior art heel unit shown in FIGS. 4 and 5.
Figure 7:
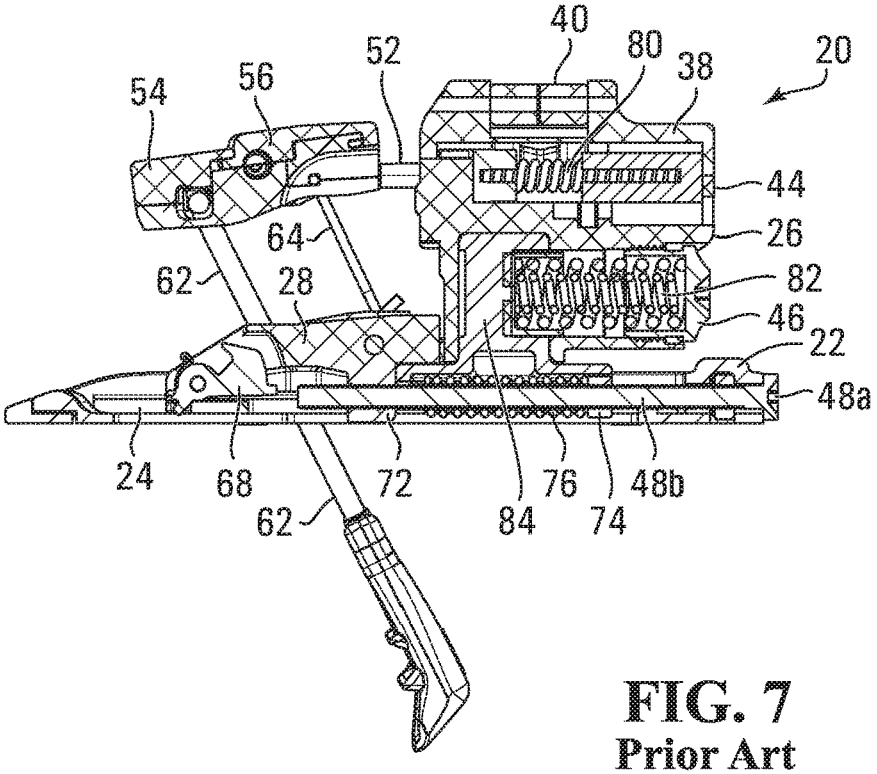
FIG. 7 Prior Art
FIG. 7 is a cross sectional view taken along line A-A in FIG. 6.

FIG. 6 is a top view of the prior art heel unit shown in FIGS. 4A and 4B in the downhill position. FIG. 7 is a cross sectional view along line A-A of FIG. 6. Threaded portion 48B of the adjustor is engaged in a threaded through-hole 72 at the bottom of brake chassis 28. Mounted on the adjustor is adjustable spring retainer 74 which bears against spring 76 which in turn biases upper portion 26 against chassis 28. Rotation of the adjustor at 48A results in the upper portion 26 and chassis 28 moving forward or backward in channel 24 of track 22 as a single unit. However, rotation of upper portion 26 such that either of lobes 30 exerts a camming effect against chassis 28 causes upper portion 26 and the chassis to be separated against the biasing effect of spring 76.

The cross section view in FIG. 7 shows spring 80 which is part of the My release components and coaxially arranged spring unit 82 which is part of the Mz release components.

Figure 8:
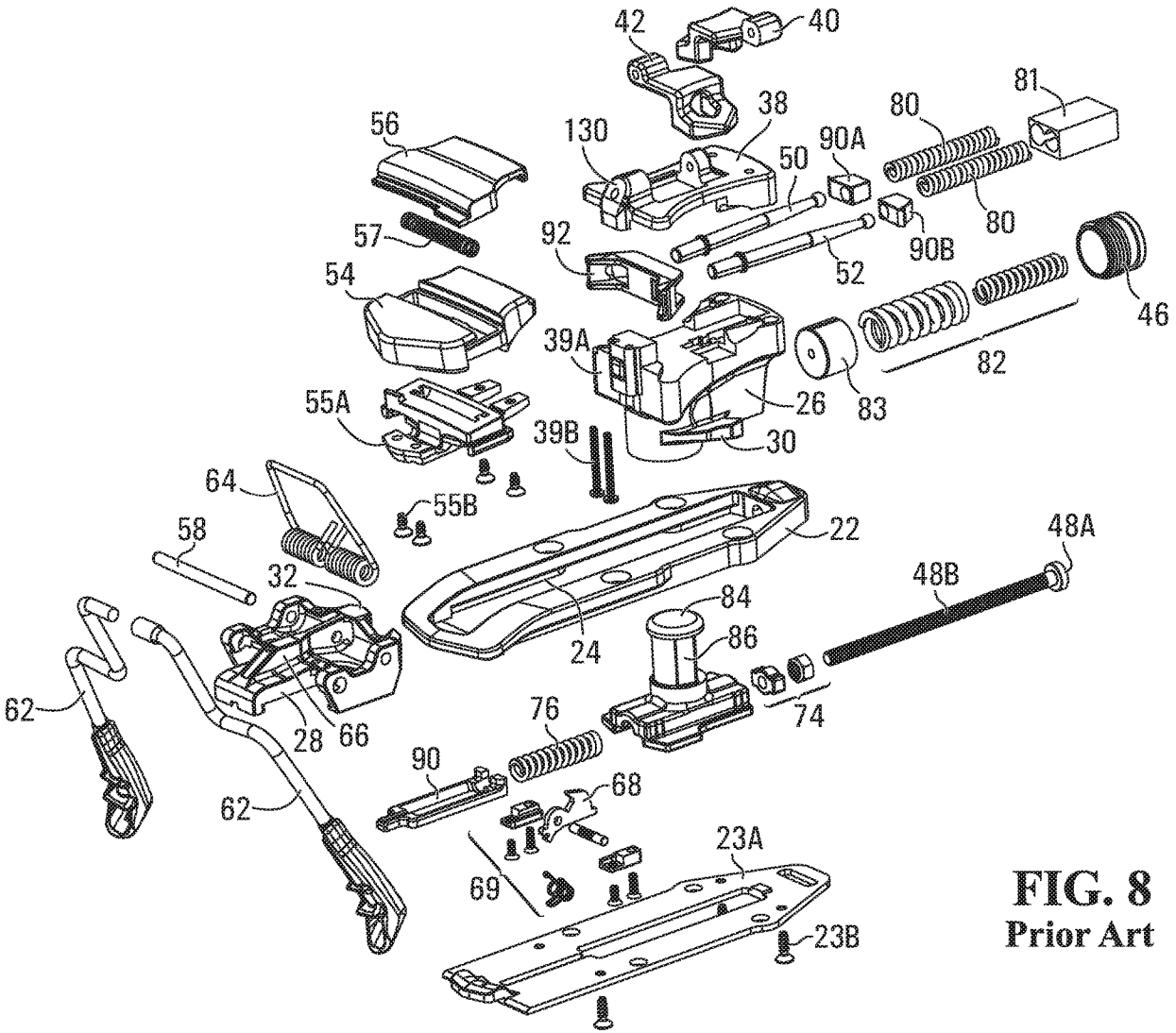
FIG. 8 Prior Art
FIG. 8 is an exploded view of the prior art heel unit illustrated in FIGS. 4-7.

FIG. 8 is an exploded view of the prior art heel unit illustrated in FIGS. 4-7. Base plate 22 comprises lower plate 23A which is joined to the base plate with appropriate threaded fasteners 23B. Post 84 is slidably engaged in channel 24 of base plate 22 and is placed within a hollow part of upper portion 26. Upper portion 26 is retained on post 84 by engagement of Mz plunger 83 on flat portion 86 of the post. Plunger 83 is retained against the flat portion by means of Mz springs 82 which are adjusted by the position of cap 46. Also shown are My springs 80, My spring base 81, pin caps 90A and 90B, pins 50 and 52 and release arm 92 which are My release components. Cover 38 is retained on upper portion 26 by being cinched through boss 39A by means of fasteners 39B which extend upward through the boss and engage with appropriate threaded openings in cover 38. One end of finger 90 is engaged underneath post 86 and the finger extends forward to contact hook 68 which is part of brake release components 69. When the binding is in the downhill position, finger 90 is translated forward and contacts the bottom of hook 68 disengaging it from a corresponding portion on spring 64. When upper portion 26 is rotated such that one of lobes 30 contacts boss 32 and the upper portion is translated rearward relative to brake chassis 28 against the biasing force of spring 76, finger 90 moves rearward allowing hook 68 to rotate forwards (assisted by its spring) to be available to engage a corresponding portion on spring 64 when brake pad 54 is depressed, thereby retaining the brake pad in the depressed position with arm 62 raised above the snow, so as to not interfere with touring. Arms 62 are sandwiched between brake pad 54 and lower brake element 55A which is attached to brake pad 54 through appropriate fasteners 55B. Sliding cover 56 is retained in position by spring 57. Axel 58 retains spring 64 in brake chassis 28.

Figure 9A:
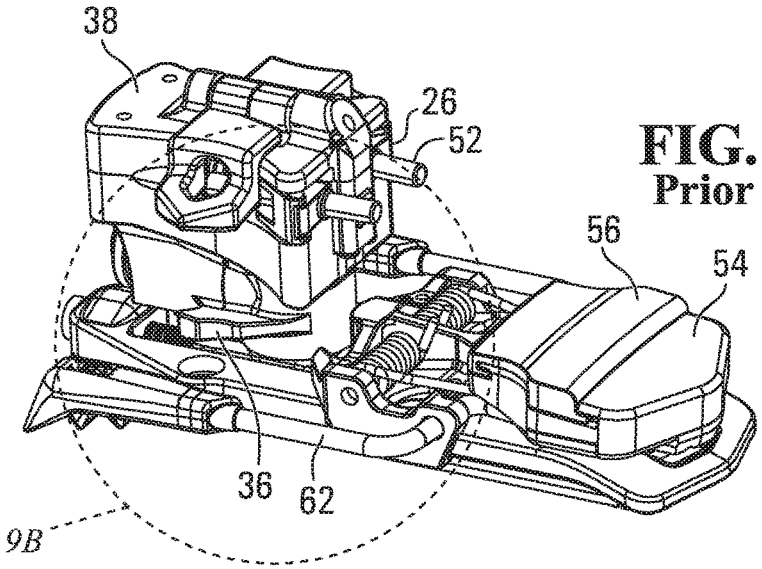
FIG. 9A Prior Art
FIGS. 9A, 10A and 11A are perspective views of the prior art heel unit illustrated in FIGS. 4 to 8 in a downhill position (FIG. 9A), in a touring position (FIG. 11A) and in an intermediate position (FIG. 10A).
Figure 9B:
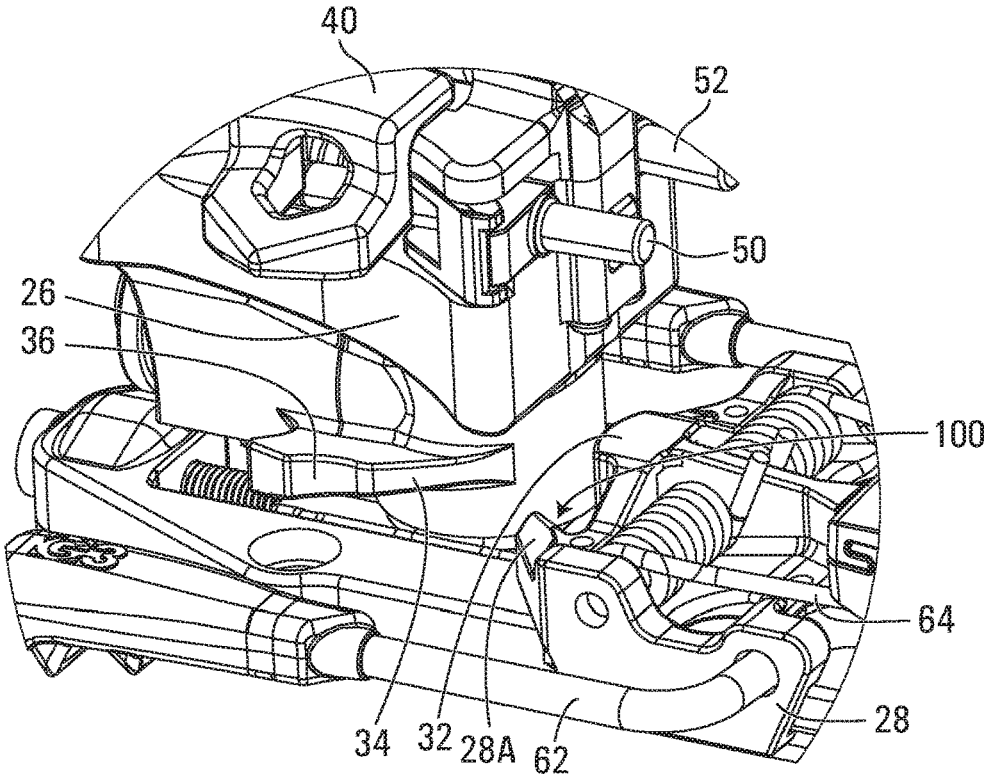
FIG. 9B Prior Art
FIGS. 9B, 10B and 11B are enlargements of partial views taken from FIGS. 9A, 10A and 11A, respectively.
Figure 10A:
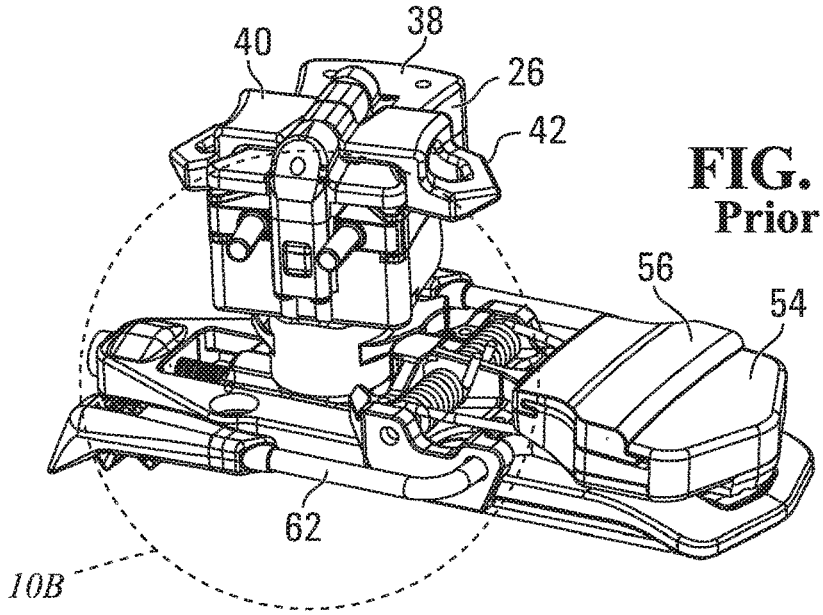
FIG. 10A Prior Art
Figure 10B:
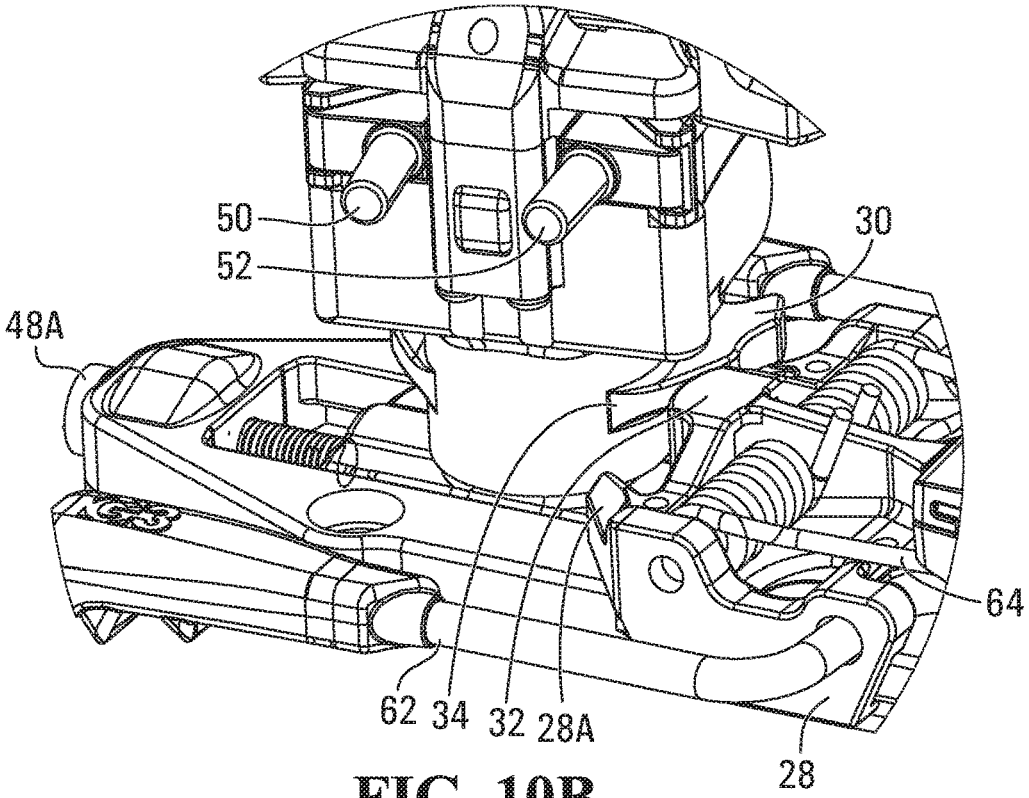
FIG. 10B Prior Art
Figure 11A:
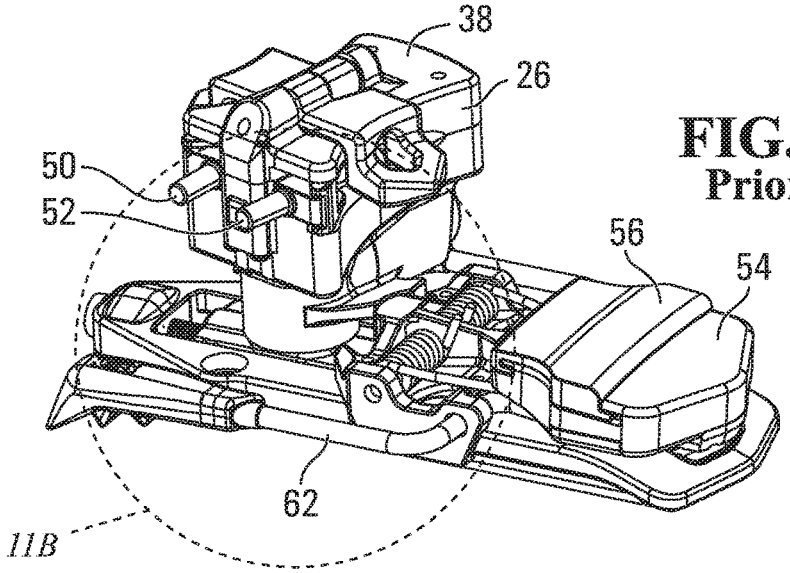
FIG. 11A Prior Art
Figure 11B:
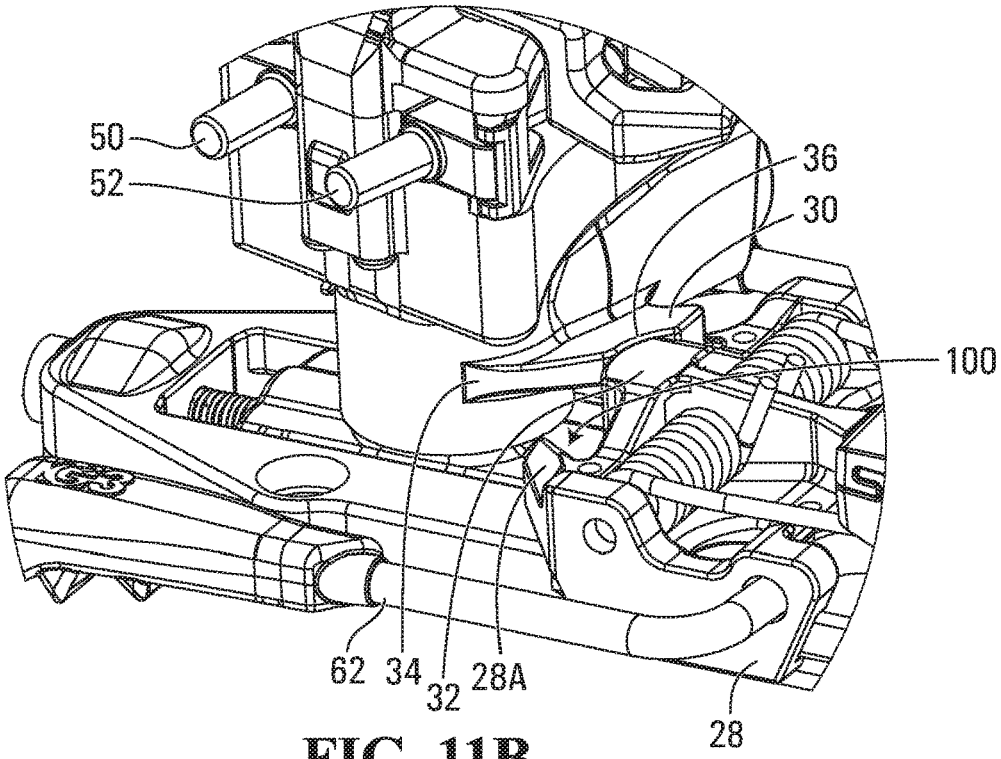
FIG. 11B Prior Art

FIG. 9B is an enlarged view of a section of FIG. 9A showing an embodiment of a heel unit as disclosed in U.S. 2015/0014963 in a downhill position. Typically when in the downhill position, the brake pad 54 is raised and brake arm 62 dropped unless a boot is engaged in the binding. For illustration purposes, FIGS. 11A and 11B show the brake pad in the depressed position as if a boot were engaged in the binding. Similarly, FIGS. 10A and 10B show the binding with upper portion 26 partially rotated towards a touring position such that the camming surface 34 of lobe 30 bears against boss 32 causing the upper portion 26 to separate from chassis 28. As illustrated in FIGS. 11A and 11B, the upper portion 26 is engaged in a touring position with boss 32 resting in detent 36 of lobe 30. In this embodiment, upper portion 26 may also be rotated in the opposite direction to a touring position whereby the lobe on the opposite side of upper portion 26 becomes engaged with boss 32.

Figure 12A:
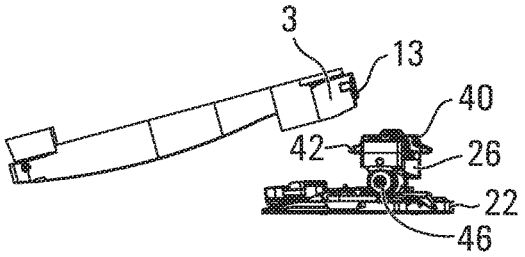
FIG. 12A Prior Art
FIGS. 12A and 13A are perspective views of the prior art heel unit illustrated in FIGS. 4 to 11 and a boot sole with heel in unweighted (12A) and weighted (13A) situations.
Figure 12B:
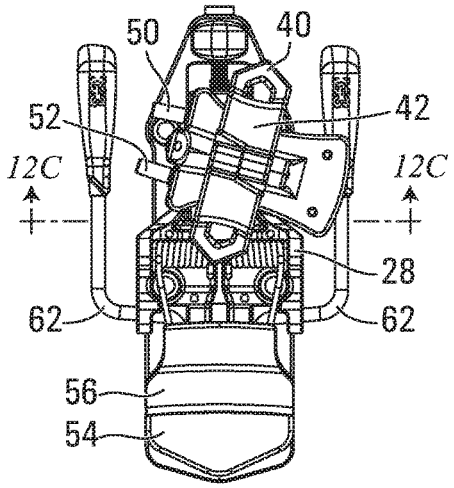
FIG. 12B Prior Art
FIGS. 12B and 13B are top views of the heel units illustrated in FIGS. 12A and 13A, respectively.
Figure 12C:
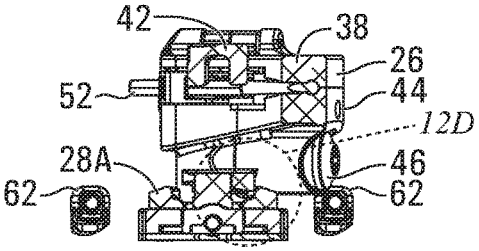
FIG. 12C Prior Art
FIGS. 12C and 13C are cross sectional views taken from FIGS. 13B and 14B, respectively.
Figure 12D:
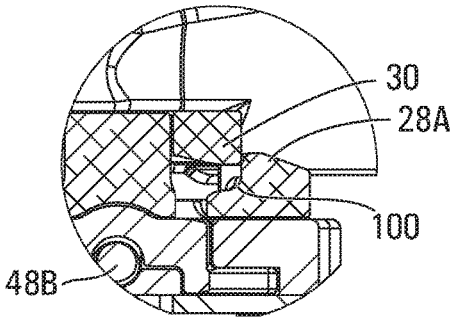
FIG. 12D Prior Art
FIGS. 12D and 13D are enlargements of partial views taken form FIGS. 13C and 14C, respectively.
Figure 13A:
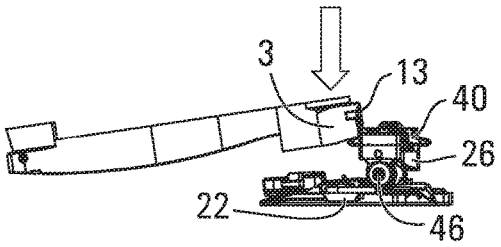
FIG. 13A Prior Art
Figure 13B:
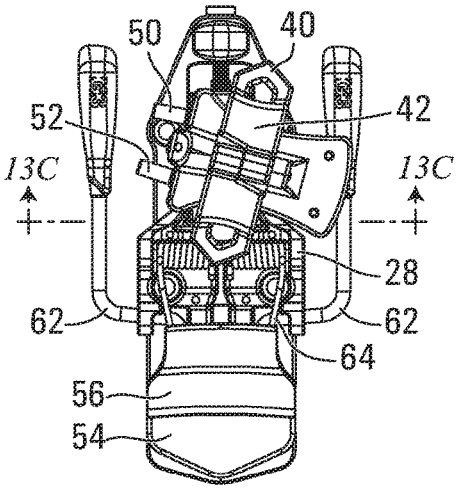
FIG. 13B Prior Art
Figure 13C:
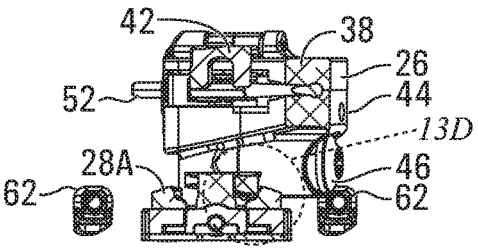
FIG. 13C Prior Art
Figure 13D:
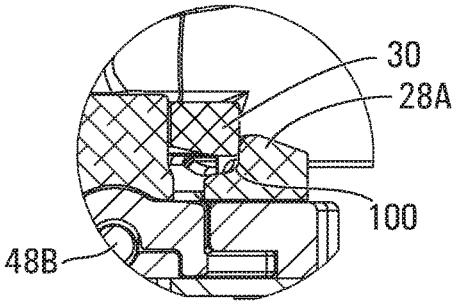
FIG. 13D Prior Art

FIG. 12A is a side view showing an embodiment of a heel unit as disclosed in U.S. 2015/0014963 in a touring position with a boot sole heel 3 shown positioned above the heel unit. The remainder of the boot is not illustrated. FIG. 12B is a top view of the heel unit in FIG. 12A. FIG. 12C is a cross sectional view along line E-E in FIG. 12B. FIG. 12D is an enlarged view of section F illustrated in FIG. 12C. As shown in FIG. 12D, rotation of the heel unit so that lobe 30 engages with brake chassis 28 causes upper portion 26 to translate rearwards relative to chassis 28. In addition to the camming surface of lobe 30 engaging with a boss on chassis 28 as described above, an under surface of lobe 30 rides up and over an inclined portion 28A of chassis 28 to become engaged in depression 100 in chassis 28 that is fixed relative to the upper portion, as illustrated in FIG. 12D. This is permitted by the flexing that occurs when lobe 30 is made from a plastic material. As shown in FIG. 12D, a portion of lobe 30 is partially engaged within depression 100. However, when weighted by the user in the touring mode as shown in corresponding FIGS. 13A-13D, lobe 30 is pressed further into depression 100 thereby ensuring that the heel unit will not rotate. When unweighted as shown in FIG. 13D, the user may easily dislodge lobe 30 from depression 100 to allow the upper portion 26 to rotate back to the downhill position. Such rotation may be facilitated by the biasing force of spring 76.

The present invention makes use of the post on which the upper portion of a Tech-type heel unit rotates in a system for reducing or preventing unintentional rotation of the upper portion from a touring position back to the downhill position. In the prior art devices, this post has served as the support and axis on which the upper portion rotates. Typically, such a post would comprise a vertically oriented spindle on which a plurality of flat zones are arranged around the circumference of the spindle. Opposing bearing surfaces were also provided on the underside of a cap on one end of the spindle and the upper side of a pedestal at the other end of the spindle. These bearing surfaces would cooperate with the side or sides of a plunger to retain the upper portion on the post and guide its rotation on the post. A distal face of the plunger abuts each of the flat zones in turn during rotation of the upper portion. Typically, the upper portion can be removed from the heel unit by removal of the plunger from engagement between the bearing surfaces of the post. An example in the prior art is post 84 comprising flat portion 86 which cooperates with plunger 83, as disclosed in U.S. 2015/0014963 and illustrated in FIG. 8 herein. When plunger 83 engages one of the flat zones on the post the upper portion is releasably retained at that location. However, the plunger can be accidentally dislodged from engagement with a flat zone when in the touring position and return to the downhill position, without the intention of the user. This can occur if sufficient rotational force is imparted by a build-up of snow or by accidental jarring that further compresses the My spring, allowing the plunger to retract and move to an adjacent flat zone corresponding to the downhill position. This is exacerbated by the presence of any additional biasing means that imparts a rotational effect.

In the embodiment of U.S. 2015/0014963 that is illustrated herein, anti-rotation features are provided to reduce or prevent accidental rotation of the upper portion from a touring position back to the downhill position. These features include the presence of inclined portion 28A which is a prominence located at a fixed position relative to the upper portion over which a part of the upper portion travels between the downhill position and a touring position. The inclined portion is adjacent to depression 100 which is also at a fixed location and receives the part of the upper portion when the upper portion is in the touring position. In the prior art embodiment illustrated herein, this is facilitated by the part of the upper portion being on a lobe having sufficient flexibility to allow it to bend while riding over the inclined portion after which the lobe becomes partially engaged in the depression. Weighting of the upper portion by the user when in the touring position causes the lobe to further engage the depression in a manner which substantially prevents rotation of the upper portion back across the inclined portion and return to the downhill position. The present invention is based on the realization that a feature or features on the post can be utilized to facilitate, enhance or even replace anti-rotation features employed in prior art Tech-type heel units.

Figure 14:
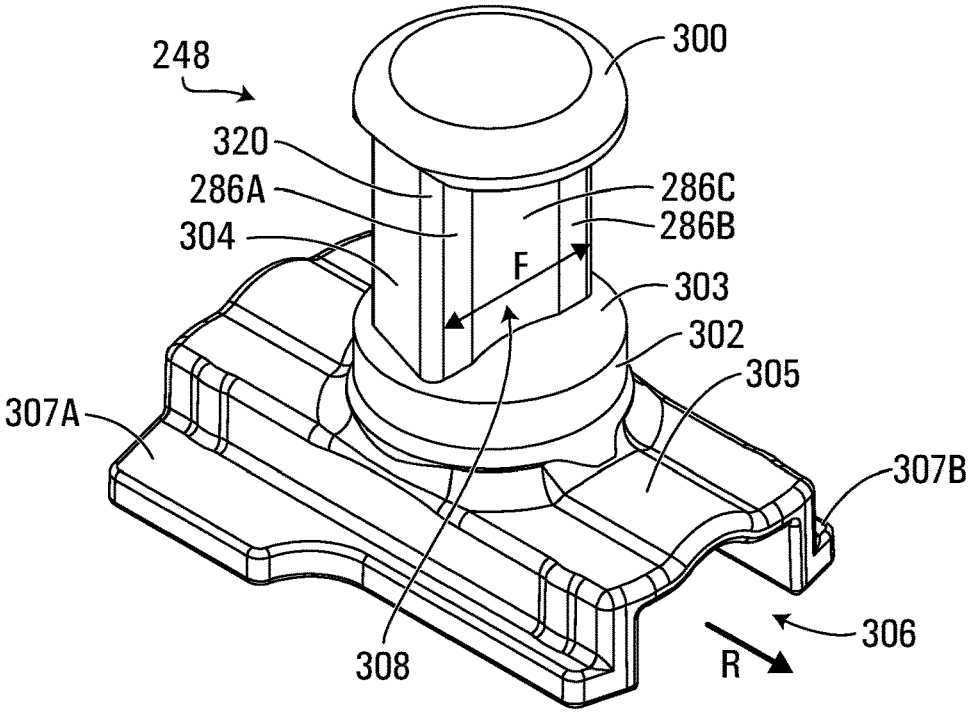
FIG. 14 is a perspective view of a heel unit post in accordance with this invention.
Figure 15:
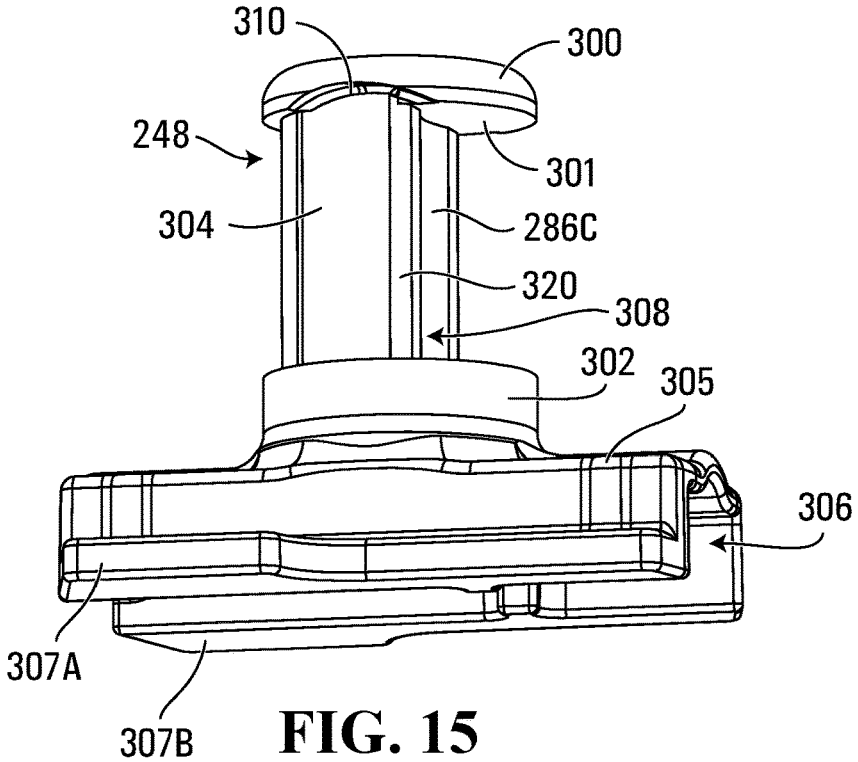
FIG. 15 is another perspective view of the post shown in FIG. 14.

FIGS. 14 and 15 illustrate one embodiment of a heel post for use in a heel unit in accordance with this invention. Illustrated heel post 248 is a replaceable component and is particularly adapted to be slidably engaged with a base plate of a heel unit which may be the same or similar to the prior art base plate 22 illustrated in FIG. 8 herein. In the illustrated embodiment, post 248 comprises a cap 300, a pedestal 302, and a spindle 308 located between cap 300 and pedestal 302. Spindle 308 comprises a generally rearward facing primary flat zone defined by line F in FIG. 14, with arrow R indicating the rearward direction. The primary flat zone of spindle 308 in this embodiment consists of two laterally spaced flat portions 286A and 286B between which is concavity 286C which acts as a grease reservoir and can reduce surface tension. Spindle 308 also comprises one or more secondary flat zones which are generally sideward facing, such as flat zone 304 shown in FIGS. 14 and 15. The primary flat zone engages with Mz components when the heel unit is in the downhill position and the Mz components engage with a secondary flat zone when the heel unit is in a touring position. On the undersurface of cap 300 is bearing surface 301. The upper surface of pedestal 302 provides opposing bearing surface 303. In the illustrated embodiment, areas of transition between the flat zones around the circumference of spindle 308 can be chamfered or curved, to reduce wear on the Mz components. An example of such a transition is curved transition region 320 in the illustrated embodiment.

Post 248 further comprises an enlarged base intended to support the post and the upper portion that engages thereto. Illustrated base 305 is elongated in the longitudinal direction and shaped to provide channel 306 to allow for components of the heel unit to be positioned beneath post 248. An example of such components could be a portion of an adjustor such as threaded portion 48B shown in FIGS. 7 and 8 herein with respect to the prior art.

Figure 16:
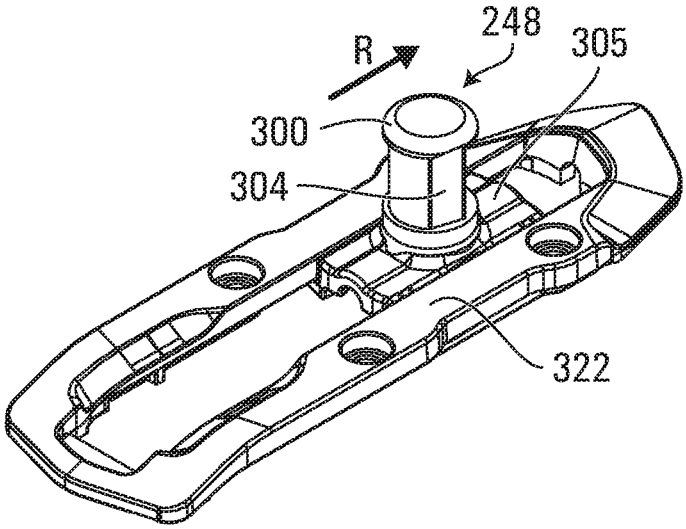
FIG. 16 is a perspective view of a heel unit post of this invention engaged with a base plate of a heel unit.

The embodiment of this invention represented by post 248 in FIGS. 14 and 15 contains generally longitudinally oriented features such as flanges 307A and 307B on opposite sides of base 305 for engagement with a base plate of a heel unit. The base plate may be the same or similar to that illustrated as base plate 22 in the prior art shown in FIG. 8 herein. This permits sliding engagement of the post in the base plate to allow for size adjustment as provided in a typical Tech-type binding and/or translation of the upper portion as described in U.S. 2015/0014963. FIG. 16 shows post 248 engaged with base plate 322. Longitudinal features present on a post of this invention for facilitating engagement with a base plate may also include sides of the base of the post comprising a generally longitudinally oriented channel or channels that engage with corresponding features in the base plate.

Figure 17:
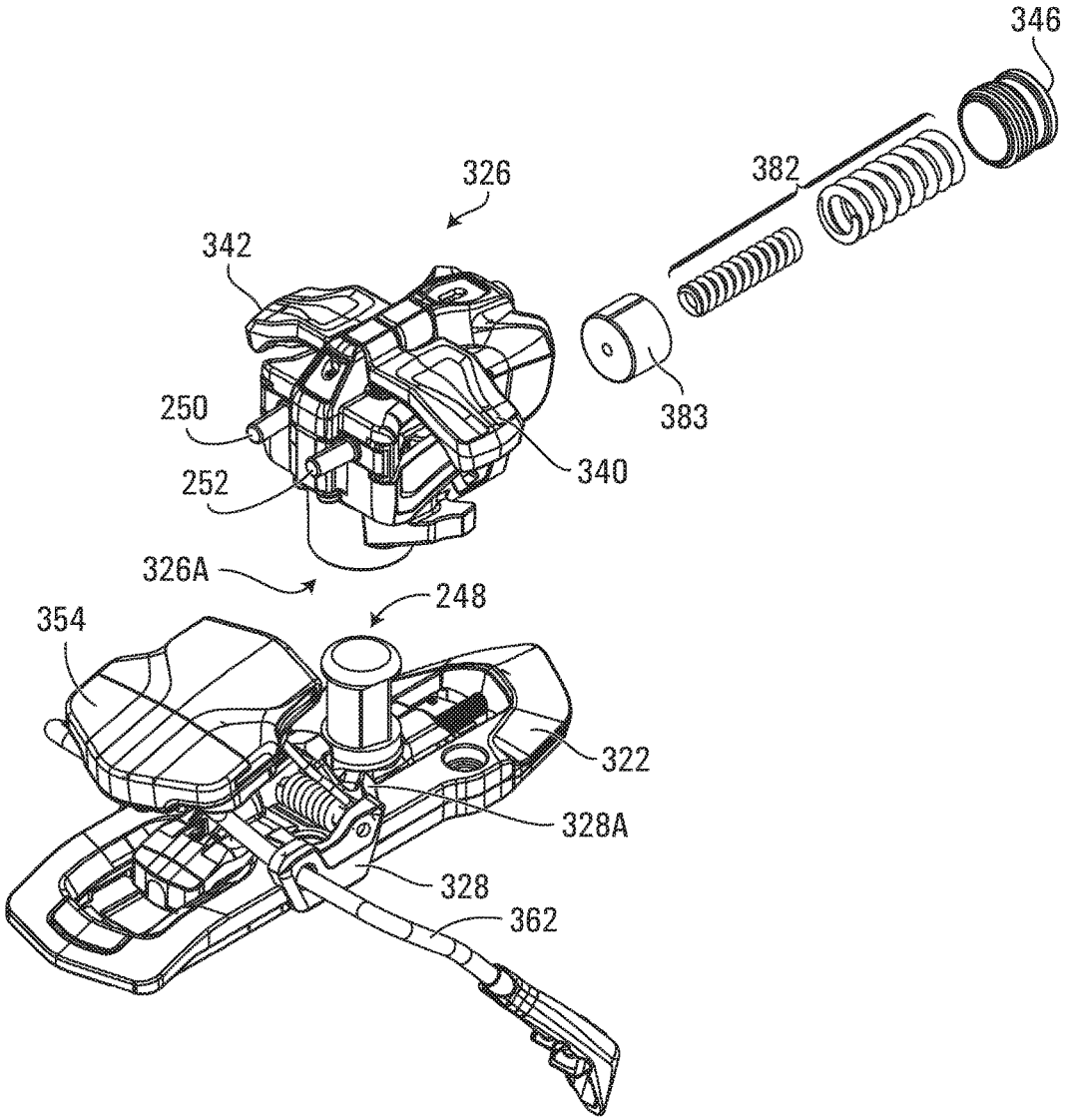
FIG. 17 is an exploded, perspective view of an improved heel unit of this invention showing its upper portion separated as a result of removal of Mz components.

FIG. 17 shows a heel unit in accordance with this invention that includes upper portion 326. In the illustrated embodiment, the upper portion comprises heel lifts 42 and 43 and forward facing pins 350 and 352. The upper portion defines a generally cylindrical recess accessed from beneath the upper portion at 326A. The recess receives post 248 when the heel unit is assembled. In the illustrated embodiment post 248 is already engaged with base plate 322. Positioned forward on base plate 322 is brake chassis 328 which includes brake pad 354 and brake arm 362. Once upper portion 326 is engaged on post 248, the upper portion is retained thereon by insertion of Mz components into the upper portion. As illustrated, the latter Mz components may include plunger 383, springs 382 and adjustment cap 346.

Figure 18A:
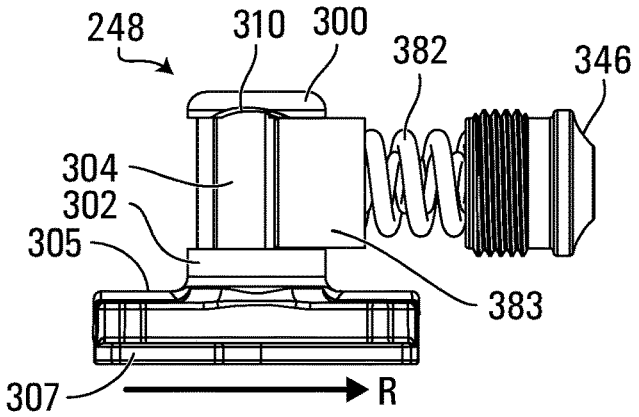
FIG. 18A is a side view of a heel unit post in accordance with this invention with Mz components engaged in the same manner that they would be in the assembled heel unit when in downhill mode.
Figure 18B:
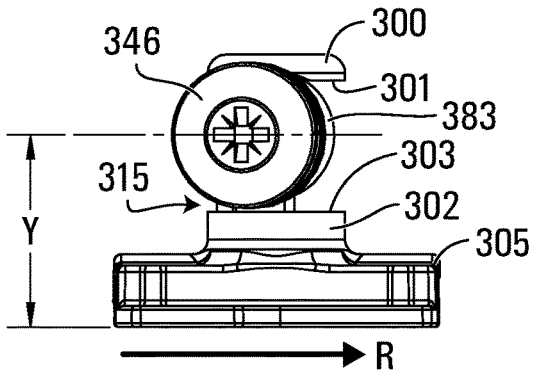
FIG. 18B shows the combination of components illustrated in FIG. 18A with the Mz components rotated sideward towards a touring position.
Figure 18C:
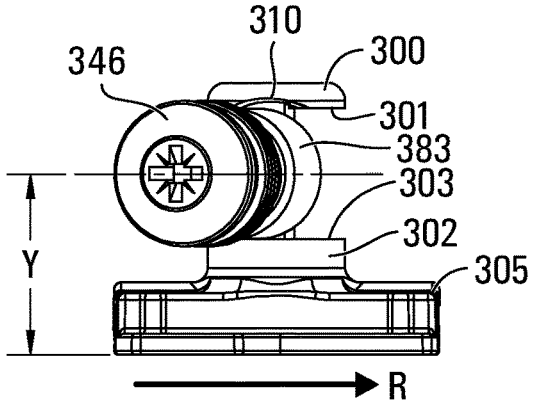
FIG. 18C shows the Mz components fully rotated to the touring position.

FIG. 18A shows the Mz components engaged with post 248 in a manner that corresponds to the downhill position. As shown, plunger 383 fits between the opposing bearing surfaces 301 and 303 provided on cap 300 and pedestal 302. A surface of spindle 308 also provides a bearing surface for the distal face of the plunger. In the downhill position, the distal face of plunger 383 rests against the primary flat zone of post 248. As shown in FIG. 18B, sideward rotation of the Mz components towards a touring position allows plunger 383 to follow groove 310 in the bearing surface of the underside of cap 300 which increases clearance within the region of the groove between the bearing surfaces of the cap and pedestal. This additional clearance is reflected by gap 315 shown in FIG. 18B. FIG. 18C shows the Mz components rotated completely to a touring position so that the distal face of plunger 383 will rest against secondary flat zone 304 of post 248 (not visible in FIG. 18C). At this point, the Mz components have travelled beyond the maximum depth of groove 310 so plunger 383 is again able to contact both bearing surfaces 301 and 303. The difference between distances X and Y in FIG. 18B and FIG. 18C, respectively represents the amount of additional clearance provided by groove 310. This difference may be in the range of about 1 to about 2 mm. In an exemplary embodiment, the aforesaid difference is about 1.5 mm.

Figure 19:
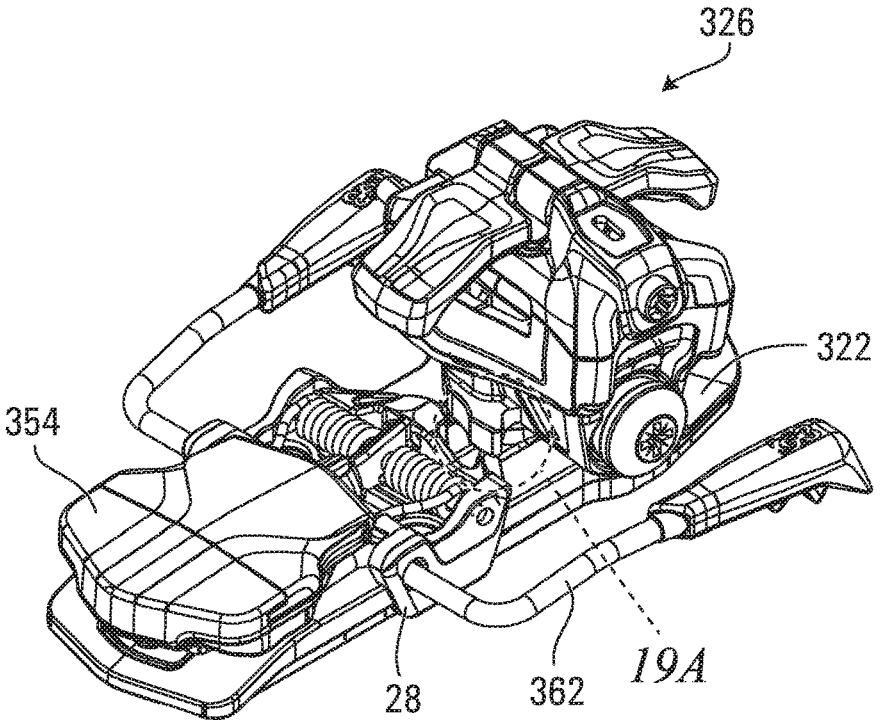
FIGS. 19 and 20 are perspective views of an assembled heel unit in accordance with this invention, with the upper portion in the same positions represented in FIGS. 18B and 18C, respectively.
Figure 19A:
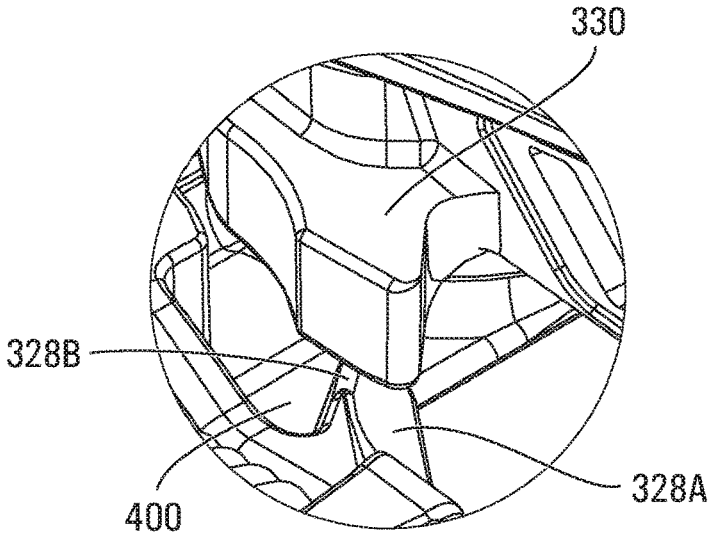
FIGS. 19A and 20A are enlargements of partial views taken from FIGS. 19 and 20, respectively.
Figure 20:
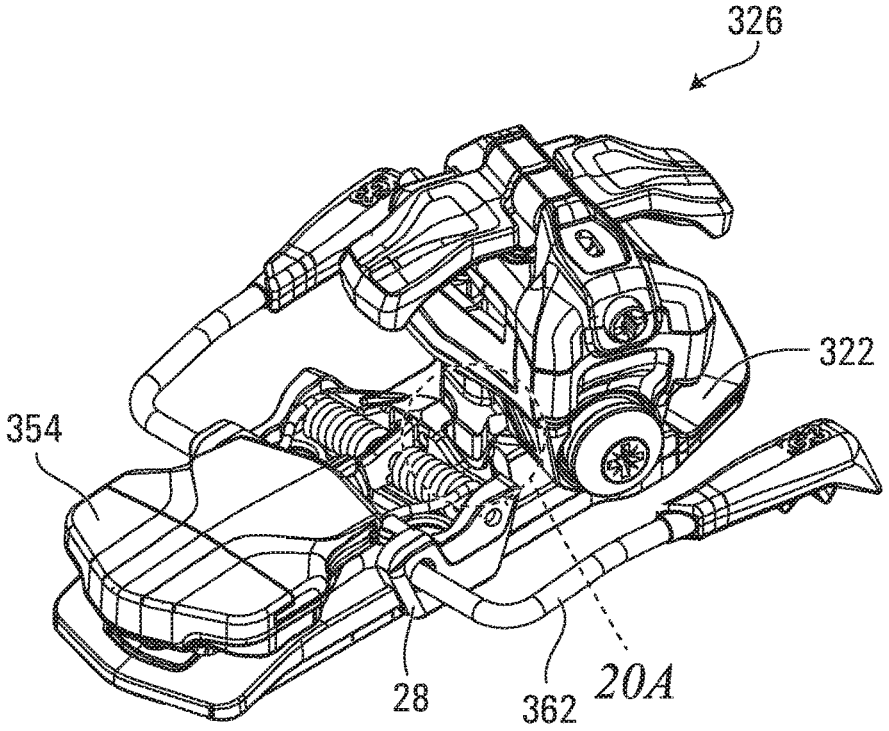
Figure 20A:
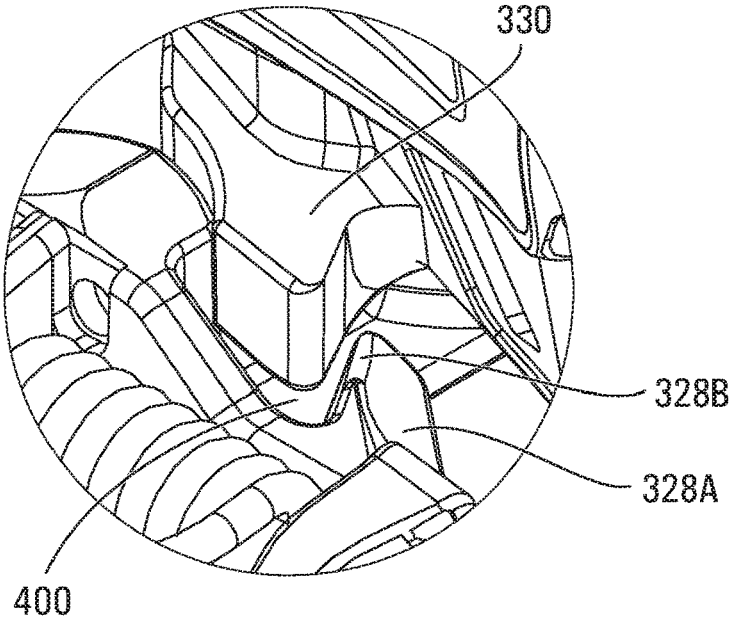

FIGS. 19 and 20 show an assembled exemplary heel unit of this invention at rotational positions corresponding to those illustrated by FIGS. 18B and 18C, respectively. The enlarged details illustrated in FIGS. 19A and 20A show lobe 330 which is part of the upper portion 326 travelling over highest point 329B of inclined face 328A and beyond, such that lobe 330 becomes positioned for engagement with depression 400 in a touring position. The apparatus is configured so that highest point 328B is positioned beneath the area of maximum depth of groove 310 in the cap of post 248. As a result, the heel unit components can be dimensioned to provide for engagement of lobe 330 into depression 400 only when weighted by the user (or to provide for greater engagement with the depression when so weighted) offering a secure restraint against rotation of upper portion 326 back to the downhill position while reducing or eliminating lobe 330 being flexible. The apparatus can be configured for close tolerances while reducing wear on high point 328B and/or on plunger 328.

Figure 21:
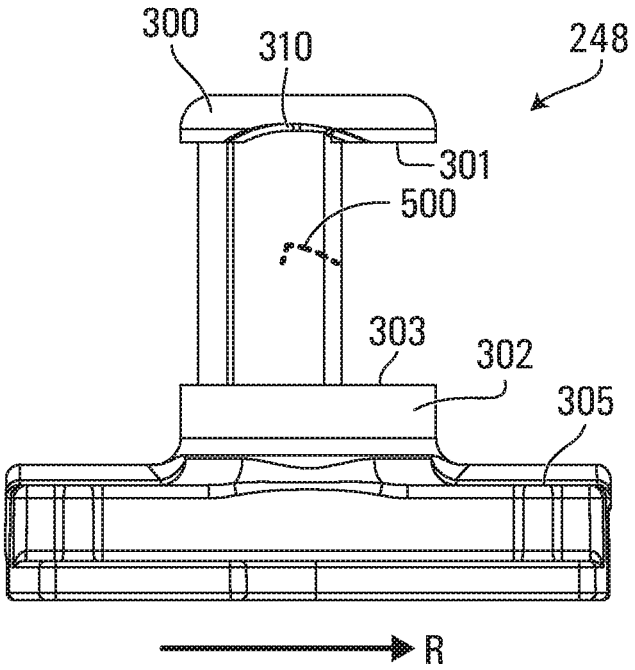
FIG. 21 is a side view of the post with a phantom line representing part of the path that an axial centre of the Mz components in the binding illustrated in FIGS. 19 and 20 will follow as the Mz components travel from the downhill to a touring position.

Phantom line 500 illustrated in FIG. 21 represents the path of travel of the centre of the distal face of flange 328 as the Mz components rotate from the downhill position to a touring position. The shape of line 500 generally corresponds to the profile presented by inclined face 328A and adjacent depression 400. As becomes clear from this illustration, other embodiments of this invention can be provided by shaping the post in other ways to achieve the same or similar result. The shape and location of groove 310 can be altered and/or re-positioned, depending upon the shape and position of a prominence on the heel unit that is used as an anti-rotation feature. For example, the groove may be placed at another location on bearing surface 301 or on the upward facing bearing surface 303 of pedestal 302. In a further alternative, plunger 383 may comprise an extending feature, for example located on the distal plunger face, which engages with a groove cut in the spindle of post 248 following a path that itself provides the prominence and depression that function as a stop to resist rotation back to the downhill position. For example, a projection located at the centre of the distal end of plunger 383 could engage with a groove cut in the spindle region of post 248 which includes a portion that follows the route illustrated by phantom line 500 in FIG. 21 and which may extend across the secondary flat zone.

Although the foregoing invention has been described in some detail by way of illustration and example for purposes of clarity of understanding, it will be readily apparent to those of skill in the art in light of the teachings of this invention that changes and modification may be made thereto without departing from the spirit and scope of the invention. All patents, patent applications and other publications referred to herein are hereby incorporated by reference.

The invention claimed is:

1. An apparatus for holding a footwear heel to a snow travel aid, the apparatus comprising:

a base mountable to the snow travel aid;

a post connected to the base; and an upper portion having at least one connector engageable with the footwear heel, the upper portion being rotatable on the post between a downhill position and at least one touring position, the upper portion comprising at least one part which travels over a prominence at a fixed location relative to the upper portion during a rotation of the upper portion on the post from the downhill position to the touring position, wherein the at least one part becomes engageable with a depression adjacent the prominence when the upper portion is in the touring position; and wherein the post comprises a groove configured to provide a clearance for the at least one part to travel over the prominence during the rotation.

2. The apparatus of claim 1, wherein the prominence extends upwardly to a high point adjacent the depression.

3. The apparatus of claim 1, wherein the post comprises a bearing surface and the groove is located on the bearing surface.

4. The apparatus of claim 3, further comprising a plunger of an Mz biasing device engaged with the bearing surface.

5. The apparatus of claim 1, wherein the prominence is a projection connected to said mountable base.

6. The apparatus of claim 5, wherein the groove is located on the post at a location over the prominence.

7. The apparatus of claim 5, wherein the at least one part comprises a lobe connected to the upper portion, and the lobe extends away from an axis of the rotation of the upper portion.

8. The apparatus of claim 5, wherein the prominence is located on a chassis, the chassis being positionable on the mountable base by an adjustor.

9. The apparatus of claim 8, further comprising a snow brake mounted on the chassis.

10. The apparatus of claim 1, wherein the post is slidable relative to the mountable base.

11. The apparatus of claim 10, wherein the at least one part comprises a lobe connected to the upper portion, the lobe further comprises a camming surface that contacts a stop at a second fixed location relative to the upper portion, and the rotation of the upper portion to the touring position results in the upper portion translating rearwardly against an opposing force provided by a biasing device.

12. The apparatus of claim 1, wherein the at least one part becomes engaged with the depression during the rotation of the upper portion to the touring position without weighting by a user.

13. The apparatus of claim 1, wherein the apparatus is configured such that weighting by a user when the apparatus is at the touring position causes or increases engagement of the at least one part with the depression.

14. The apparatus of claim 1, comprising two groups, each group being located at opposite sides of the apparatus wherein each group consists of said at least one part, prominence and depression, and wherein the upper portion is rotatable in opposite directions.

15. The apparatus of claim 1, wherein the at least one connector is a pair of pins.

16. A system comprising a ski and a touring binding mounted to the ski, wherein the touring binding comprises the apparatus defined in claim 1.

17. A kit comprising the apparatus of claim 1 and a toe unit of a touring binding.

18. The apparatus of claim 1, wherein the post comprises a cap, a pedestal, and a spindle located between the cap and the pedestal.

19. The apparatus of claim 18, wherein the groove is located on the cap, the pedestal, or the spindle.

20. The apparatus of claim 18, wherein the spindle is located between the cap and the pedestal in a vertical direction, and the groove extends in the vertical direction so that the clearance is a vertical clearance.

21. An apparatus for holding a footwear heel to a snow travel aid, the apparatus comprising a base mountable to the snow travel aid that is connected to a post and an upper portion engaged with the post and having at least one connector for connecting the upper portion to the heel, the upper portion being rotatable on the post between a downhill position and at least one touring position; wherein the post comprises a spindle between a cap and a pedestal, the cap and pedestal being larger in cross section than the spindle, the pedestal being joined to a post base having a larger cross section than the pedestal, the post base comprising a feature or features oriented in a generally longitudinal direction for slidable engagement of the post with said mountable base, the spindle comprising a primary flat zone generally facing in longitudinal direction and at least one secondary flat zone facing generally sideward, wherein an underside of the cap comprises a bearing surface and an upper surface of the pedestal comprises an opposing bearing surface and wherein the one or both of said bearing surfaces comprise at least one groove that increases clearance between said bearing surfaces at the location of the groove.

22. The post of claim 21, wherein the at least one groove is located on the bearing surface on the underside of the cap.

23. The post of claim 21, wherein the at least one groove increases clearance in an area that includes at least part of the at least one secondary flat zone.

24. The post of claim 21, comprising secondary flat zones on opposite sides of the spindle and wherein the bearing surface on the underside of the cap comprises grooves located over at least part of each of the secondary flat zones.

25. The post of claim 21, wherein a portion or portions of the surface of the spindle located between the flat zones is curved, chamfered, or a combination thereof.

26. A kit comprising the post of claim 21 and instructions for its incorporation into said apparatus.

27. An apparatus for holding a footwear heel to a snow travel aid, the apparatus comprising a base mountable to the snow travel aid that is connected to a post and an upper portion engaged with the post and having at least one connector for connecting the upper portion to the heel, the upper portion being rotatable on the post between a downhill position and at least one touring position; wherein the post comprises a spindle joined to a post base having a larger cross section than the spindle, the post base comprising a feature or features oriented in a generally longitudinal direction for slidable engagement of the post with said mountable base, the spindle providing a bearing surface that comprises a primary flat zone generally facing the longitudinal direction and at least one secondary flat zone facing generally sideward, and wherein the bearing surface of the spindle comprises at least one groove extending across at least part of the at least one secondary flat zone, the groove being shaped to provide a path containing a prominence followed by a depression in a direction extending away from the primary flat zone.

28. The post of claim 27, wherein the groove extends across the secondary flat zone.

29. The post of claim 27, comprising secondary flat zones on opposite sides of the spindle, each comprising said groove.

30. The post of claim 27, wherein a portion or portions of the bearing surface of the spindle located between the flat zones is curved, chamfered, or a combination thereof.

31. A kit comprising the post of claim 27 and instructions for its incorporation into said apparatus.

* * * * *